US005261186A

United States Patent [19]

Saino

[11] Patent Number: 5,261,186

[45] Date of Patent: Nov. 16, 1993

[54] FIRE DOOR CLOSURE RESET SYSTEM

[75] Inventor: Felix H. Saino, Memphis, Tenn.

[73] Assignee: F. L. Saino Manufacturing Co., Memphis, Tenn.

[21] Appl. No.: 942,158

[22] Filed: Sep. 8, 1992

[51] Int. Cl.[5] ..... E05F 15/20

[52] U.S. Cl. ..... 49/8; 49/31; 49/379; 160/1

[58] Field of Search ..... 49/1, 2, 5, 7, 8, 31, 49/139, 140, 379, 404; 160/1, 4, 6, 8

[56] References Cited

U.S. PATENT DOCUMENTS

| | | | |
|---|---|---|---|
| 604,053 | 5/1898 | Lane . | |
| 826,574 | 7/1906 | Hudson . | |
| 830,745 | 9/1906 | Smith . | |
| 1,249,013 | 12/1917 | Boyd . | |
| 1,249,566 | 12/1917 | Waldman . | |
| 3,166,155 | 1/1965 | Clark | 189/47 |
| 3,383,796 | 5/1968 | Fredrick, Jr. et al. | 49/7 |
| 3,398,482 | 8/1968 | Frederick, Jr. | 49/8 |
| 3,438,147 | 4/1969 | Lander | 49/7 |
| 4,404,768 | 9/1983 | Cristy | 160/8 X |
| 4,467,562 | 8/1984 | Hemmerling | 49/411 |
| 4,648,310 | 3/1987 | Wescoat et al. | 98/1 |
| 4,664,170 | 5/1987 | Labelle | 160/8 X |
| 4,805,261 | 2/1989 | Barchechat | 49/2 X |
| 4,912,878 | 4/1990 | Bentley | 49/379 |

*Primary Examiner*—Peter M. Cuomo
*Assistant Examiner*—Michael J. Milano
*Attorney, Agent, or Firm*—Walker, McKenzie & Walker

[57] ABSTRACT

A fire door closure reset system including a fire door movable between an opened position and a closed position relative to an opening through a wall; a lock for being pivotally attached relative to the wall for movement between a locked position and an unlocked position and for allowing the fire door to move to the closed position when in the unlocked position; a spring for urging the lock to the unlocked position; a cable having a first end for being attached to the lock and having a second end for being fixedly attached relative to the wall; the lock being held in the locked position when the cable is taut; the spring urging the lock to the unlocked position when slack is placed in the cable; occurrence responsive structure for placing slack in the cable in the event of a predetermined occurrence; and a test-reset mechanism for allowing the operation of the fire door closure reset system to be tested by placing slack in the cable and for allowing the slack in the cable to be subsequently removed after the operation of the fire door closure reset system is tested to reset the fire door closure reset system.

3 Claims, 5 Drawing Sheets

FIG. 7
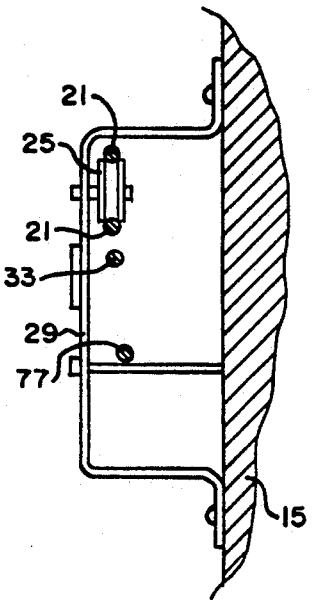
FIG. 8
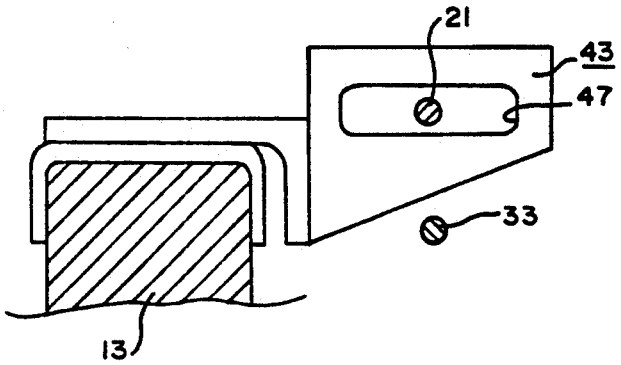
FIG. 9
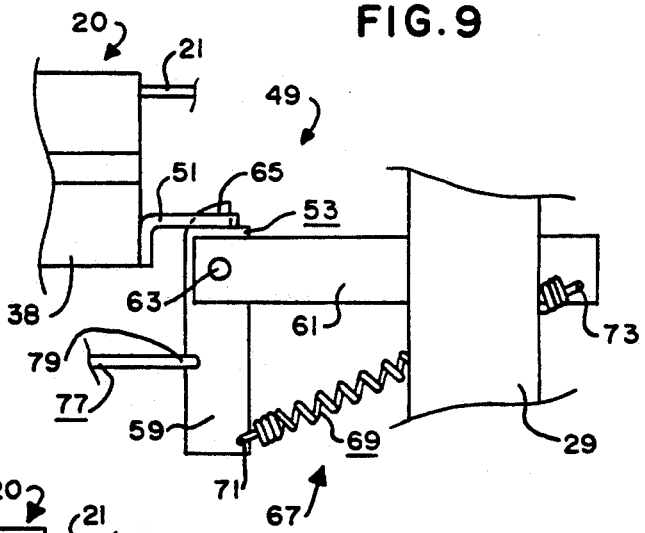
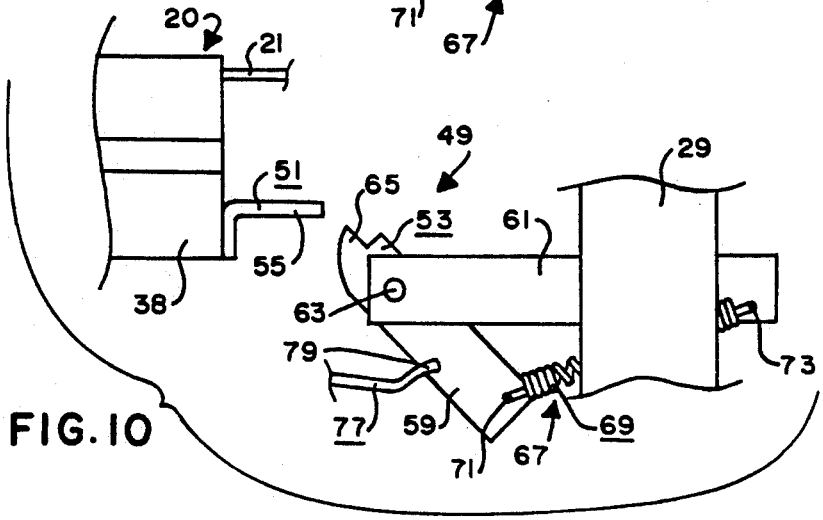
FIG. 10

FIRE DOOR CLOSURE RESET SYSTEM

CROSS-REFERENCE TO RELATED APPLICATIONS

This is, in part, a substitute of U.S. application Ser. No. 7/715,405, filed Jun. 14, 1991, entitled "FIRE DOOR CLOSURE RESET SYSTEM," now abandoned, which was a continuation-in-part of U.S. application Ser. No. 07/508,566, filed Apr. 13, 1990, entitled "FIRE DOOR CLOSURE SYSTEM," now abandoned.

BACKGROUND OF THE INVENTION

1. Field of the Invention: The present invention relates, in general, to a system for closing fire doors that can be quickly and easily tested by merely moving a test handle to a test position, and that can be quickly and easily reset by merely moving the fire door back to an opened position and moving the test handle back to a set position.

2. Information Disclosure Statement: Fire doors that close automatically in the event of a fire or other predetermined occurrence are well known in the art. However, it is necessary to test such fire doors on a periodic basis to insure that they will operate correctly in the event of a fire or other predetermined occurrence. A long-standing problem with such testing is the difficulty and time-consuming nature of properly re-setting such fire doors after a test. The known prior fire door closure systems require substantial time, know-how, and skill to restring cables, reattach fusible links, etc., in order to reset the system after a test.

A preliminary patentablity search has been conducted in class 49, subclasses 7 and 8.

Frederick, U.S. Pat. No. 3,398,482, issued Aug. 27, 1968, and Hemmerling, U.S. Pat. No. 4,467,562, issued Aug. 28, 1984, disclose fire door closure systems that are heat responsive based on a fusible link to close a fire door or allow a fire door to close in the event of a fire. Neither Frederick, U.S. Pat. No. 3,398,482, nor Hemmerling, U.S. Pat. No. 4,467,562, disclose a means to test and reset the system other than melting or releasing a fusible link.

Wescoat et al., U.S. Pat. No. 4,648,310, issued Mar. 10, 1987, discloses an apparatus for causing a curtain or the like to move to a closed position in the event of a fire or the like. The Wescoat et al. apparatus includes a manual release arm for allowing the system to be manually activated. However, once manually activated, substantial work and repair will be required to reset the system. Thus, for example, the glass face of a box would have to be replaced, and at least one worker would most likely be required to properly position the manual release arm and a plurality of linkage arms and the like while another worker properly positioned the pull ring within the box, etc.

The present invention is directed toward providing a fire door closure system that can be tested by merely moving a test handle to a test position, and that can be reset by merely moving the fire door back to an opened position and moving the test handle back to a set position. None of the above patents disclose or suggest a closure reset system including a fire door movable between an opened position and a closed position relative to an opening through a wall; lock means for being pivotally attached relative to the wall for movement between a locked position and an unlocked position and for allowing the fire door to move to the closed position when in the unlocked position; urging means for urging the lock means to the unlocked position; a cable having a first end for being attached to the lock means and having a second end for being fixedly attached relative to the wall; the lock means being held in the locked position when the cable is taut; the urging means urging the lock means to the unlocked position when slack is placed in the cable; occurrence responsive mean for placing slack in the cable in the event of a predetermined occurrence; and test-reset means for allowing the operation of the fire door closure reset system to be tested by placing slack in the cable and for allowing the slack in the cable to be subsequently removed after the operation of the fire door closure reset system is tested to reset the fire door closure reset system.

SUMMARY OF THE INVENTION

The present invention is directed toward providing an improved closure reset system for fire doors and the like. The concept of the present invention is to provide a closure system that allows the operation of the closure system to be easily tested, and that can be easily and quickly reset after being tested.

The closure reset system of the present invention includes, in general, a fire door movable between an opened position and a closed position relative to an opening through a wall; lock means for being pivotally attached relative to the wall for movement between a locked position and an unlocked position and for allowing the fire door to move to the closed position when in the unlocked position; urging means for urging the lock means to the unlocked position; a cable having a first end for being attached to the lock means and having a second end for being fixedly attached relative to the wall; the lock means being held in the locked position when the cable is taut; the urging means urging the lock means to the unlocked position when slack is placed in the cable; occurrence responsive means for placing slack in the cable in the event of a predetermined occurrence; and test-reset means for allowing the operation of the fire door closure reset system to be tested by placing slack in the cable and for allowing the slack in the cable to be subsequently removed after the operation of the fire door closure reset system is tested to reset the fire door closure reset system.

One objective of the present invention is to provide a closure reset system specifically designed to allow the closure reset system to be quickly and easily tested and easily and simply reset after a test thereof, etc.

Another objective of the present invention is to provide a fire door closure system that can be tested by merely moving a test handle to a test position, and that can be reset by merely moving the fire door back to an opened position, and moving the test handle back to a set position.

BRIEF DESCRIPTION OF THE DRAWINGS

FIG. 7 is an enlarged sectional view substantially as taken on line 7—7 of FIG. 1.

FIG. 8 is an enlarged sectional view substantially as taken on line, 8—8 of FIG. 1.

FIG. 9 is a somewhat diagrammatic view of the lock means of the first embodiment of the closure reset system of the present invention.

FIG. 10 is a somewhat diagrammatic view similar to FIG. 9, but with certain components in a moved position.

DESCRIPTION OF THE PREFERRED EMBODIMENTS

Figure 1:
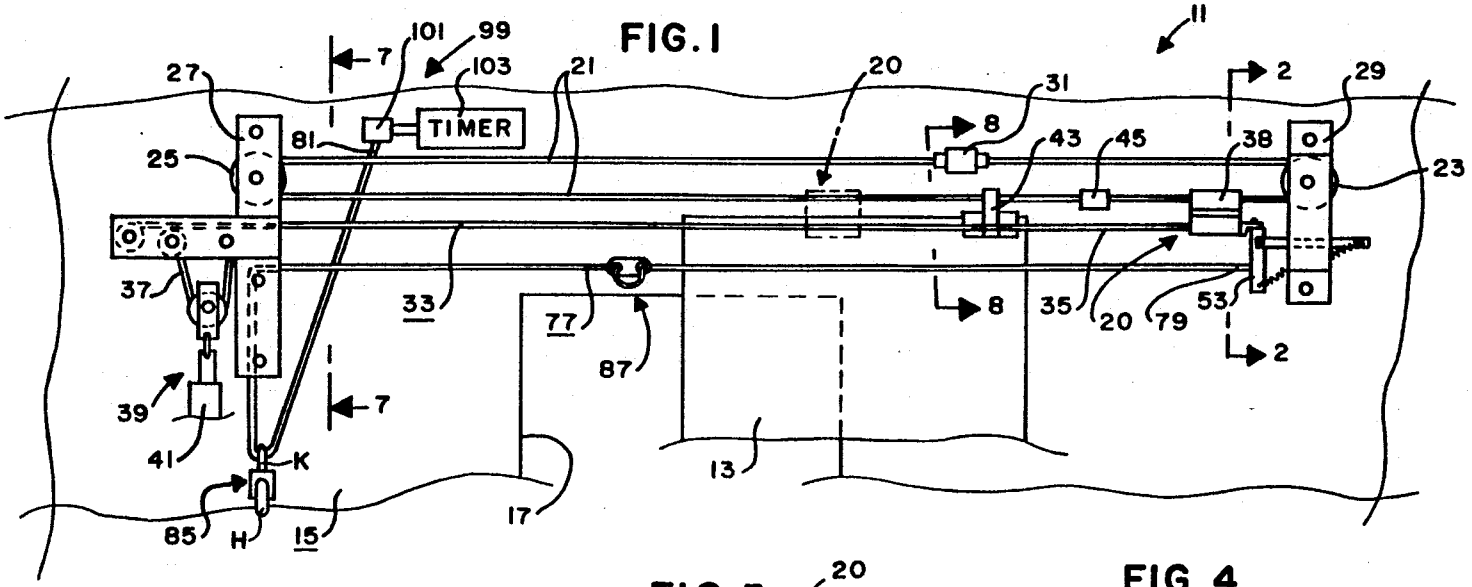
FIG. 1 is a somewhat diagrammatic view of a horizontally sliding fire door with a first embodiment of the closure reset system of the present invention combined therewith.
Figure 4:
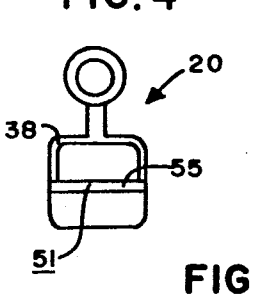
FIG. 4 is an end view of FIG. 3 with portions thereof omitted for clarity.
Figure 3:
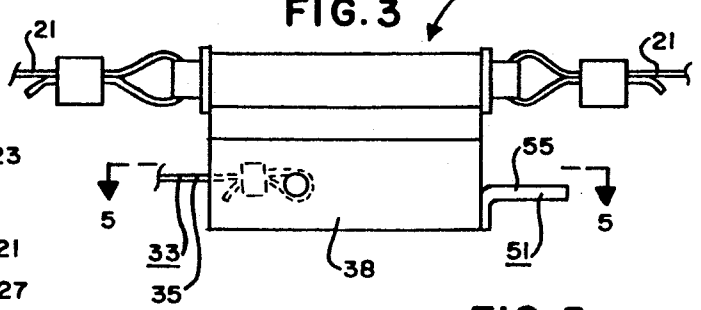
FIG. 3 is an enlarged and detailed view of a closure member and associated structure of the first embodiment of the closure reset system of the present invention.
Figure 2:
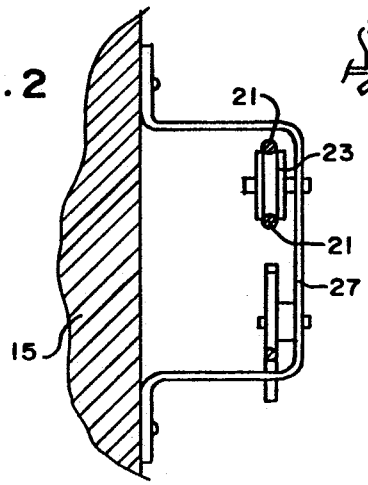
FIG. 2 is an enlarged sectional view substantially as taken on line 2—2 of FIG. 1.
Figure 5:
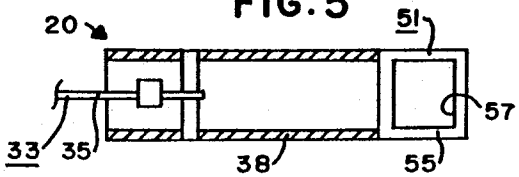
FIG. 5 is a sectional view as taken on line 5—5 of FIG. 3.
Figure 6:
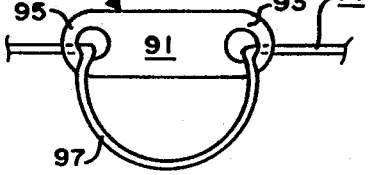
FIG. 6 is a somewhat diagrammatic view of a fuse link means of the first embodiment of the closure reset system of the present invention.

A first preferred embodiment of the closure reset system of the present invention is shown in FIGS. 1-10 and identified by the numeral 11.

The closure reset system 11 includes or is designed especially for use in combination with a fire door 13 (or a plurality of fire doors) that is movably mounted on a wall 15 for selectively closing an opening 17 through the wall 15.

The closure reset system 11 includes control means for controlling movement of the fire door 13 from an opened position to a closed position. The control means of the closure reset system 11 is movable between an opened position and a closed position and the fire door 13 moves to the closed position when the control means moves to the closed position.

The control means preferably includes means for mounting the fire door 13 relative to the wall 15 in such a manner so that the fire door 13 can be moved between the opened and closed position in a controlled manner. More specifically, the fire door 13 may be slidably mounted on the wall 15 by various typical support track means and the like (not shown) well known to those skilled in the art for horizontal movement between a closed position in which the opening 17 through the wall 15 is closed and an opened position in which the opening 17 through the wall 15 is open, etc., as will now be apparent to those skilled in the art. A primary function of the closure reset system 11 is to forcefully close the fire door 13 in the event of a fire or during a test of the closure reset system 11, and to allow the closure reset system 11 to be easily reset thereafter.

The control means of the closure reset system 11 preferably includes closure means for forcing the fire door 13 to the closed position. The closure means preferably includes a closure member 20 movable between an opened position as shown in solid lines in FIG. 1 and a closed position as shown in broken lines in FIG. 1. The fire door 13 is allowed to remain in the opened position when the closure member 20 is in the opened position (or, typically, in any other position between fully opened and fully closed as will now be apparent to those skilled in the art such as the partially opened position shown in FIG. 1) and is forced to the closed position when the closure member 20 is moved to the closed position.

The closure reset system 11 includes a continuous or endless belt, chain or cable means 21 for movement between an opened position and a closed position and for being attached to the control means in such a manner that the control means will be prevented from moving from the opened position to the closed position when the continuous cable means 21 is locked in the opened position and in such a manner that the control means will be moved from the closed position to the opened position when the continuous cable means 21 is moved from the closed position to the open position. The continuous cable means 21 is preferably held above the fire door 13 between a first end pulley 23 and a second end pulley 25. The first end pulley 23 may be rotatably mounted to the wall 15 on one side of the opening 17 by a bracket 27. Likewise, the second end pulley 25 may be rotatably mounted to the wall 15 on the other side of the opening 17 by a bracket 29. A turn buckle 31 may be provided for allowing the length of the continuous cable means 21 to be adjusted as will now be apparent to those skilled in the art.

The closure means preferably includes a closure cable 33 having a first end 35 and a second end 37. The first end 35 of the closure cable 33 is preferably attached to the closure member 20 The closure member 20 is preferably attached to the continuous cable means 21. More specifically, the closure member 20 preferably includes a body member 38 with opposite ends of the cable means 2 securely attached thereto to make the cable means 21 continuous as will now be apparent to those skilled in the art, and with the first end 35 of the closure cable 33 securely attached thereto as clearly shown in FIGS. 3 and 5.

The control means is normally urged to the closed position. Thus, for example, the closure reset system 11 preferably includes urging means 39 for normally urging the control means to the closed position. More specifically, the urging means 39 is designed for normally urging the closure member 20 to the closed position and for, thereby, normally urging the fire door 13 to the closed position The urging means 39 preferably includes spring reels, weights 41, or the like, coupled to the second end 37 of the closure cable 33 for normally pulling the closure cable 33 toward the left in FIG. 1 to, thereby, normally pull the fire door 13, closure member 20 and the bottom run of the continuous cable means 21 toward the left in FIG. 1 in a manner as will hereinafter become apparent A catch bracket 43 is preferably fixedly attached to the top of the fire door 13 as clearly shown in FIG. 8. The closure means preferably includes a closure lug 45 for being securely attached to the continuous cable means 21 in a position for engaging the catch bracket 43 to force the fire door 13 to the closed position when the closure member 20 is moved to the closed position as will now be apparent to those skilled in the art. The closure lug 45 is preferably adjustable on the cable means 21 to allow the closure of the fire door 13 to be adjusted as will now be apparent to those skilled in the art. It should be noted that when a pair of fire doors are to be controlled by the system 11, an additional closure lug may be fixedly coupled to the upper run of the continuous cable means 21 for closing the additional fire door as will now be apparent to those skilled in the art. The catch bracket 43 is clearly shown in FIG. 8 and preferably includes an aperture 47 for allowing the lower run of the continuous cable means 21 to extend therethrough. The closure lug 45 is sized so that it will not pass through the aperture 47 but will, rather, engage the catch bracket 43 adjacent the aperture 47 to cause the catch bracket 43, and the fire door 13, to move With the continuous cable means 21 as will now be apparent to those skilled in the art.

The closure reset system 11 includes lock means 49 for being pivotally attached relative to the wall 15 for movement between a locked position and an unlocked position and for allowing the fire door 13 to move to the closed position when the look means 49 is in the unlocked position. Thus, the lock means 49 preferably has a locked position for locking the continuous cable means 21 in the opened position, and has an unlocked position for allowing the fire door 13 to move to the closed position upon the occurrence of a predetermined event.

The lock means 49 preferably includes a first latch member or means 51 for being fixedly attached relative to the continuous cable means 21 and a second latch member or means 53 for being attached relative to the wall 15. The second latch means 53 is movable between a first or locked position shown in FIGS. 1 and 9 in which the first latch means 51 can be locked thereto to hold the continuous cable means 21 in the opened position, and a second or unlocked position shown in FIG. 10 in which the first latch means 5 is released or freed therefrom for allowing the continuous cable 21 to be moved to the closed position and for allowing the urging means 39 to urge the control means to the closed position so that the fire door 13 will move to the closed position. The first latch means 51 preferably includes a ring 55 fixedly attached to the end of the body member 38 opposite the closure cable 33 (see, in general, FIG. 5). The ring 55 preferably has an aperture 57 or the like therein. The second latch means 53 preferably includes a finger 59 that is pivotally attached to an arm 61 through a pivot 63. The arm 61 is, in turn, fixedly attached to the bracket 27 which is fixedly attached to the wall 15 whereby the finger 59 is pivotally attached to the wall 15 as will now be apparent to those skilled in the art. The finger 59 has a tip 65 for extending into the aperture 57 of the ring 55 of the first latch means 51 when the second latch means 53 is in the locked position and the closure member 20 is in the opened position to lock the first latch means 51 thereto.

The lock means 49 preferably includes urging means 67 for urging the second latch means 53 to the unlocked position. The urging means 67 preferably includes a spring 69 for normally holding the second latch means 53 in the unlocked position. The spring 69 may include a typical coil spring having a first end 71 attached to the finger 59 at a position on the opposite side of the pivot 63 from the tip 65, and having a second end 73 attached to the arm 61 or the like whereby the second latch means 53 will be urged to the unlocked position as shown in FIG. 10 and as will now be apparent to those skilled in the art.

The closure reset system 11 includes reset means for urging the second latch means 53 of the lock means 49 to the first position so that the first latch means 51 can be easily and quickly re-locked to the second latch means 53 for locking the continuous cable means 21 in the opened position after the fire door 13 has moved to the closed position when the fire door 13 is subsequently moved back to the opened position (i.e., after the fire door 13 has moved to the closed position and has been subsequently re-opened).

The reset means preferably includes holding means for normally holding the second latch means 53 in the locked position. The holding means preferably includes a cable means or cable 77 for holding the second latch means 53 in the locked position when substantially tight and for allowing the second latch means 53 to move to the unlocked position when slack. The cable 77 has a first end 79 for being attached to the finger 59 at a position on the opposite side of the pivot 63 from the tip 65, and has a second end 81 for being fixedly anchored by, for example, being attached to the wall 15 or the like so that when the cable 77 is held substantially tight, the force of the spring 69 will be overcome and the second latch means 53 will be held in the locked position as will now be apparent to those skilled in the art.

The closure reset system 11 preferably includes trigger means for causing the holding means to release the second latch means 53 to thereby allow the second latch means 53 to move to the unlocked position and, in turn, force the fire door 13 to the closed position. The trigger means may include a manual release means 85 mounted, for example, on the wall 15 adjacent the second end 81 of the cable 77 to allow a worker to manually release the holding means by merely putting sufficient slack in the cable 77 to allow the finger 59 to pivot to the unlocked position and thereby force the fire door 13 to the closed position as will now be apparent to those skilled in the art. The manual release means 85 may be of various specific construction as will now be apparent to those skilled in the art such as the Model A1-11-702-20 test handle made by Southco Inc. of Concordville, Pa. 19331. Thus, the manual release means 85 may include a handle H for being manually moved between a lowered or set position and a raised or test position, and a keeper K or the like for being operatively coupled to the handle H and the cable 77 in such a manner that movement of the handle H to the raised position will place slack in the cable 77 and movement of the handle H to the lowered position will remove slack from the cable 77 as will now be apparent to those skilled in the art.

The closure reset means 11 includes occurrence responsive means for placing slack in the cable 77 in the event of a predetermined occurrence. The occurrence responsive means is preferably part of the trigger means and preferably includes at least one alarm means 87 such as a fuse link means 89 for putting slack in the cable 77 in the event of a fire or the like as will now be apparent to those skilled in the art. The fuse link means 89 may include a typical fuse link 91 having a first end 93 fixedly attached to a first portion of the cable 77 and having a second end 95 fixedly attached to a second portion of the cable 77 in a manner so that a loop 97 of the cable 77 is formed between the first and second ends 93, 95. The loop 97 is longer than the fuse link 91 so that if the fuse link 91 melts in the event of a fire or otherwise breaks, etc., the loop 97 will create sufficient slack in the cable 77 to allow the finger 59 to pivot to the unlocked position and thereby force the fire door 13 to the closed position as will now be apparent to those skilled in the art. The trigger means preferably includes at least three such fuse link means 89. That is, the trigger means preferably includes a first fuse link means 89 positioned directly above the opening 17 through the wall 15 as shown in FIG. 1, a second fuse link means (not shown) positioned on one side of the wall 15 adjacent the ceiling, and a third fuse link means (not shown) positioned on the other side of the wall 15 adjacent the ceiling.

The trigger means may also include a linear actuator release means or device 101 coupled to the second end 81 of the cable 77 for putting sufficient slack in the cable 77 when activated to allow the finger 59 to pivot to the unlocked position, and may also include a timer 103 electrically coupled to the release device 101 for activating the release device 101 at one or more preselected times. The linear actuator release device 101 preferably includes a typical linear actuator such as the Model 6Z087 linear actuator made by Dayton Electric Mfg., Co. of Chicago, Ill. 60048. A battery backup system is preferably coupled to the linear actuator to allow operation thereof in the event of power failure. The battery backup system may include a float charger such as Model PSC-12500-F and a battery such as Model PS-1242, both made by Powersonic Corp. of Redwood City, Calif. The timer 103 may include any typical timer well known to those skilled in the art such as the Dayton electronic, 365-day, programmable, 2-circuit timer, Stock No. 5A687, manufactured by Dayton Electric Mfg., Co. of Chicago, Ill. 60048. The timer 103 thus allows the fire door 13 to be closed when desired and without requiring an operator by merely programming the timer 103 to activate the release device 101 at various specific times such as at night, on weekends, during holidays, etc., as will now be apparent to those skilled in the art. It should be noted that a single timer 103 could be electrically coupled to a plurality of linear actuator release devices 101 of a plurality of fire doors 13 so that a single timer 103 could control a plurality of linear actuator release devices 101 as will now be apparent to those skilled in the art.

The closure reset system 11 is specifically designed to allow the fire door 13 to be quickly and easily opened and properly reset after a test thereof, etc. Thus, once the fire door 13 has been closed by the closure reset system 11 due to a test of the closure reset system 11 (e.g., after the manual release means 85 has been activated to test the closure reset system by merely moving the test handle thereof to the test or opened position), or after circumstances have activated the alarm means 87 (e.g., after a fire substantially adjacent the fuse link 91 or after a brown out, etc.), or after the timer 103 has activated the release device 101, the cable 77 is again tightened in a manner which will now be apparent to those skilled in the art (i.e., the manual release means 85 closed by merely moving the test handle thereof back to the set or closed position, the fuse link 91 replaced, or the release device 101 deactivated, etc.) to cause the finger 59 of the second latch means 53 to move to the locked position (i.e., to urge the finger 59 to the position shown in FIG. 9). Then, the fire door 13 can be merely moved, manually or otherwise, to the fully opened position which will cause catch bracket 43 to engage and push the closure lug 45 which will cause the continuous cable means 21 to rotate, moving the first latch means 51 toward the second latch means 53 until the tip 65 of the finger 59 catches the ring 55 to lock the closure member 20 in the opened position as will now be apparent to those skilled in the art. The continuous cable means 21 will keep the closure member 20 in proper alignment with the catch bracket 43 and lock means 49 as the closure means 20 moves between the opened and closed positions as will now be apparent to those skilled in the art. The closure reset system 11 can be used to close a center parting door or a single slide door with the same system and with one closure reel or one weight closure instead of two closure reels or weight closures typically required with center parting doors, etc., as will now be apparent to those skilled in the art.

Operation of the closure reset system 11 is quite simple. With the closure member 20 in the opened position, with the test-reset means in the set position (e.g., with the handle H of the manual release means 85 in the lowered position) and with the occurrence responsive means in a ready-to-use condition (e.g., with the fuse link means 89, etc., in a normal, operation condition as will now be apparent to those skilled in the art), the cable 77 will be held substantially tight or taut, the second latch member 53 will be held in the substantially vertical, locked positions, and the closure member 20 will be locked in the opened position. To then test the closure reset system 13, a worker need only move the handle H of the manual release means 85 to the test or raised position whereby slack will be placed in the cable 77, allowing the urging means 67 to urge the second latch member 53 of the lock means 49 to the unlocked position and, thereby, causing the closure member 20 to move to the closed position to make sure the fire door 13 is closed. To then reset the closure reset system 11, the worker need only move the closure member 20 back to the opened position and move the handle H of the manual release means 85 back to the set or lowered position to thereby remove slack from the cable 77 and, assuming the fuse link means 89, etc., are in normal, operation conditions, cause the cable 77 to be held substantially tight or taut, thereby locking the closure member 20 in the opened position. It should be noted that the urging means 67 will hold the second latch member 53 in the unlocked position until the cable 77 is held substantially tight or taut.

As thus constructed and used, the closure reset system 11 provides a system that allows a fire door to be closed anytime it is desired to have the door closed, even from a remote location, and provides a system that, with the use of limit switches and the like, allows a fire door to be used, in normal day-to-day use, as a manual door that can be left in any position and could be closed automatically at night or any other desired time, that can be tied into an alarm system so that if any door that is supposed to be closed is not closed, an alarm is produced (either locally, or to a fire department, etc.), and/or that can provide the user with information that a certain door did not close the night before, etc., so that appropriate service can be performed.

A second preferred embodiment of the closure reset system of the present invention is shown in FIGS. 11-16 and identified by the numeral 2.11.

The closure reset system 2.11 includes or is designed especially for use in combination with a roll-up fire door 2.13 that is movably mounted on a wall 2.15 for selectively closing an opening 2.17 through the Wall 2.15.

The closure reset system 2.11 includes control means for controlling movement of the fire door 2.13 from an opened position to a closed position. The control means of the closure reset system 2.11 is movable between an opened position and a closed position and the fire door 2.13 moves to the closed position when the control means moves to the closed position.

The control means preferably includes means for mounting the fire door 2.13 relative to the wall 2.15 in such a manner so that the fire door 2.13 can be moved between the opened and closed position in a controlled manner. More specifically the fire door 2.13 may be rotatably mounted on the wall 2.15 by an axle A that is, in turn, rotatably mounted on the wall 2.15 by various support brackets B or the like as clearly shown in FIGS. 11 and 12 for rotation movement between a closed position and an opened position to cause the fire door 2.13 to move between a closed position as shown in broken lines in FIG. 11 in which the opening 2.17 through the wall 2.15 is closed and an opened position as shown in solid lines in FIG. 11 in which the opening 2.17 through the wall 2.15 is open, etc., as will now be apparent to those skilled in the art. Various cover members and the like have been omitted from the drawings for clarity and are not necessary for operation of the closure reset system 2.11. A primary function of the closure reset system 2.11 is to allow the fire door 2.13 to close in the event of a fire or during a test of the closure reset system 2.11, and to allow the closure reset system 2.11 to be easily reset thereafter.

The control means is normally urged to the closed position. Thus, the fire door 2.13 is preferably designed so that gravity will normally cause the fire door 2.13 to move to the closed position, causing the axle A and related mechanisms to move to a closed position as will now be apparent to those skilled in the art. The control means may include means such as spring means 2.20 coupled to the axle A for controlling the rate at which gravity will cause the axle A to rotate from the opened position to the closed position and, in turn, cause the fire door 2.13 to move from the opened position to the closed position. More specifically, the spring means 2.20 is preferably designed and set so as to allow gravity to slowly rotate the axle A and slowly move the fire door 2.13 from the opened position to the closed position to prevent damage to the fire door 2.13 and/or adjacent structure and to prevent injury to persons or things within the opening 2.17 when the fire door 2.13 moves from the opened to the closed position as will now be apparent to those skilled in the art. While the spring means 2.20 is shown diagrammatically in FIG. 11 as being mounted between the wall 2.15 and the axle A, it will be apparent to those skilled in the art that the spring means 2.20 includes a helical twist spring located inside the axle A, etc.

The closure reset system 2.11 includes lock means 2.49 for being pivotally attached relative to the wall 2.15 for movement between a locked position and an unlocked position and for allowing the fire door 2.13 to move to the closed position when the lock means 2.49 is in the unlocked position. The lock means 2.49 thus allows the fire door 2.13 to move to the closed position upon the occurrence of a predetermined event that causes the lock means 2.49 to move from the locked position to the unlocked position.

The closure reset system 2.11 includes a continuous or endless cable or chain means 2.51 for movement between an opened position and a closed position and for being attached to the control means in such a manner that the control means will be prevented from moving from the opened position to the closed position when the endless chain 2.51 is locked in the opened position and in such a manner that the endless chain 2.51 will be moved from the closed position to the opened position when the control means is moved from the opened position to the closed position.

The control means preferably includes a drive train 2.52 or the like (see FIGS. 11 and 12) for coupling the endless chain 2.51 to the axle A so that rotation of the axle A will cause rotation of the endless chain 2.51, so that movement of the endless chain 2.51 will cause rotation of the axle A, and so that preventing movement of the endless chain 2.51 will prevent rotation of the axle A and, thus, prevent movement of the fire door 2.13. Therefore, the drive train 2.52 is preferably designed in such a way that if the endless chain 2.51 is locked in position so that it cannot move, the axle A will also be prevented from rotation as will now be apparent to those skilled in the art. On the other hand, if the endless chain 2.51 is not locked in position, gravity will cause the axle A to rotate, normally urging the control means to the closed position and normally forcing the fire door 2.13 to the closed position and causing the endless chain 2.51 to move in the direction as indicated by the arrow C in FIGS. 11, 12, 14, and 16. Likewise, if the endless chain 2.51 is not locked in position and the fire door 2.13 is in the closed position, manual pressure can be applied thereto in the direction indicated by the arrow D in FIGS. 11, 12, 14, and 16 to cause the axle A to rotate and move the fire door 2.13 back to the opened position as will now be apparent to those skilled in the art. This movement will also "un-wind" the spring means 2.20 as will now be apparent to those skilled in the art. The drive train 2.52 preferably includes a number of sprockets, pulleys, gears, belts, or the like as somewhat diagrammatically shown in FIGS. 11 and 12 to allow the force necessary to apply to the endless chain 2.51 to prevent the fire door 2.13 from moving from the opened position to the closed position or to move the fire door 2.13 from the closed position to the opened position to be controlled as Will now be apparent to those skilled in the art. It will also be apparent to those skilled in the art that the drive train 2.52 can be designed so that the directions of the arrows C, D can be reversed.

The lock means 2.49 preferably includes a first latch means or member for being fixedly attached relative to the endless chain 2.51, and a second latch means or member 2.53 for being attached relative to the wall 2.15. The endless chain 2.51 is preferably constructed of a plurality of link members joined end-to-end in any typical manner now apparent to those skilled in the art and the first latch means is preferably defined by or consists of a link member 2.55 of the endless chain 2.51. Each link member 2.55 preferably has a slot 2.57 therein and the second latch member 2.53 is designed so as to selectively engage the slot 2.57 of a link member 2.55 of the endless chain 2.51 to prevent movement of the endless chain 2.51, etc., as will now be apparent to those skilled in the art. Thus, the second latch member 2.53 is movable between a first or locked position shown in FIG. 14 in which the first latch means (i.e., the link member 2.55 of the endless chain 2.51) can be locked thereto for locking the endless chain 2.51 in the opened position and to prevent movement thereof, and a second or unlocked position shown in FIG. 16 in which the first latch means (i.e., the link member 2.55 of the endless chain 2.51) is released therefrom for allowing the endless chain 2.51 to be moved to the closed position to allow the control means to be urged to the closed position so that the fire door 2.13 will move to the closed position. The second latch member 2.53 preferably includes a finger 2.59 that is pivotally attached to a support means 2.61 through a pivot 2.63. The support means 2.61 is, in turn, fixedly attached relative to the wall 2.15 as clearly shown in FIG. 13 whereby the finger 2.59 is pivotally supported relative to the wall 2.15 as will now be apparent to those skilled in the art. The finger 2.59 preferably has a tip 2.65 for extending into the slot 2.57 of the link member 2.55 of the endless chain 2.51 when the second latch member 2.53 is in the locked position as clearly shown in FIG. 14 to lock the endless chain 2.51 in place as will now be apparent to those skilled in the art.

Figure 16:
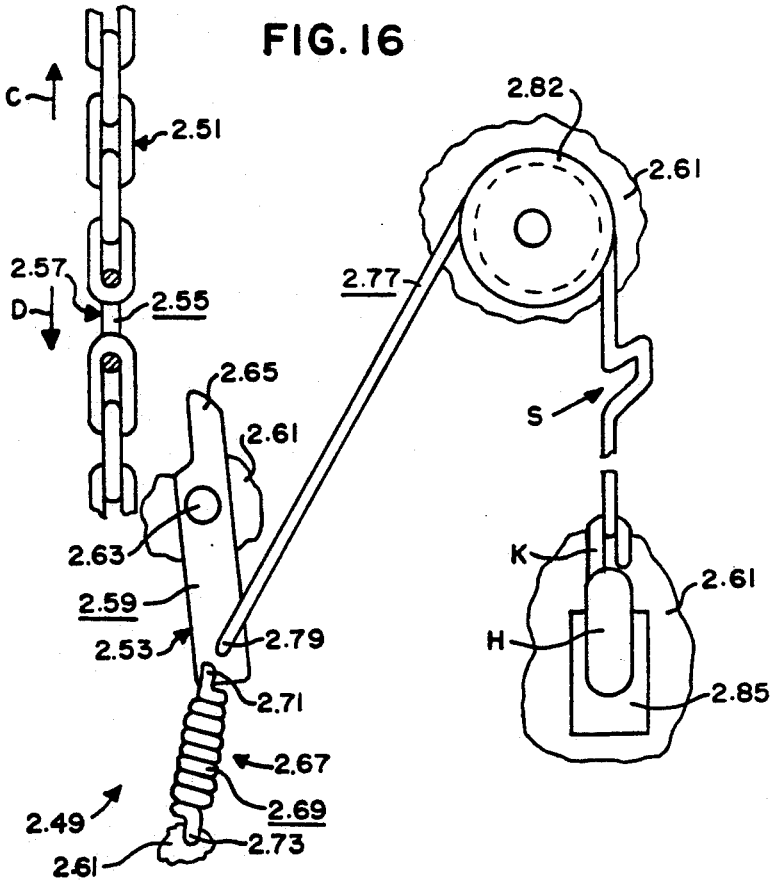
FIG. 16 is a somewhat diagrammatic view similar to FIG. 14 with certain components in a moved position.

The closure reset system 2.11 includes urging means 2.67 for urging the second latch member 2.53 to the unlocked position. The urging means 2.67 preferably includes a spring 2.69 for normally holding the finger 2.59 in the substantially vertical, unlocked position as shown in FIG. 16. The spring 2.69 may include a typical coil spring having a first end 2.71 attached to the end of the finger 2.59 opposite the tip 2.65 thereof, and having a second end 2.73 attached relative to the wall 2.15 (e.g., indirectly to the wall 2.15 through a portion of the support means 2.61 or the like) whereby the finger 2.59 will be urged to the substantially vertical, unlocked position as shown in FIG. 16 and as will now be apparent to those skilled in the art.

The closure reset system 2.11 includes reset means for urging the second latch member 2.53 of the lock means 2.49 to the first or locked position so that the first latch means (i.e., the link member 2.55 of the endless chain 2.51) so that the first latch means (i.e., the link member 2.55) can be easily and quickly re-locked to the second latch member 2.53 for locking the endless chain 2.51 in the opened position after the fire door 2.13 has moved to the closed position when the fire door 2.13 is subsequently moved back to the opened position (i.e., for easily and quickly re-locking the lock means 2.49 after the fire door 2.13 has moved to the closed position and has been subsequently re-opened).

The reset means preferably includes holding means for normally holding the second latch member 2.53 in the locked position against the force of the closure means. The holding means preferably includes a cable means or cable 2.77 for holding the second latch member 2.53 in the locked position when substantially tight and for allowing the second latch member 2.53 to move to the unlocked position when slack. The cable 2.77 has a first end 2.79 for being attached to the finger 2.59 at a position on the opposite side of the pivot 2.63 from the tip 2.65 (see FIGS. 14 and 16), and has a second end 2.81 for being fixedly anchored by, for example, being attached to the wall 2.15 or the like by an eyebolt E or the like (see FIGS. 11 and 12) so that when the cable 2.77 is held substantially tight, the force of gravity acting on the endless chain 2.51 through the axle A and drive train 2.52 will be overcome and the second latch member 2.53 will be held in the locked position as will now be apparent to those skilled in the art. A plurality of pulleys 2.82 or the like are preferably provided to control the path of the cable 2.77 as will now be apparent to those skilled in the art.

Figure 14:
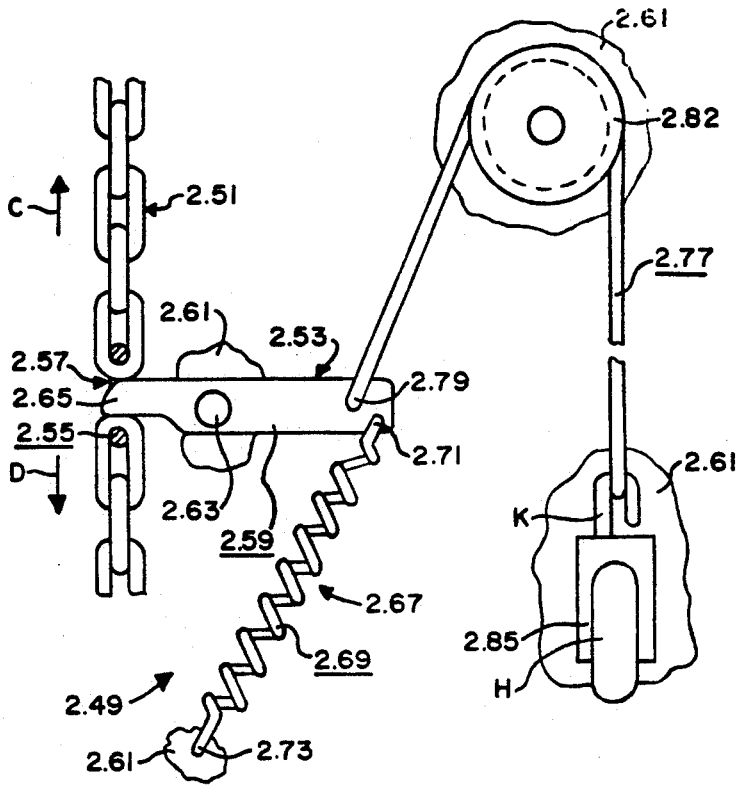
FIG. 14 is a somewhat diagrammatic view of certain portions of the second embodiment of the closure reset system of the present invention.
Figure 15:
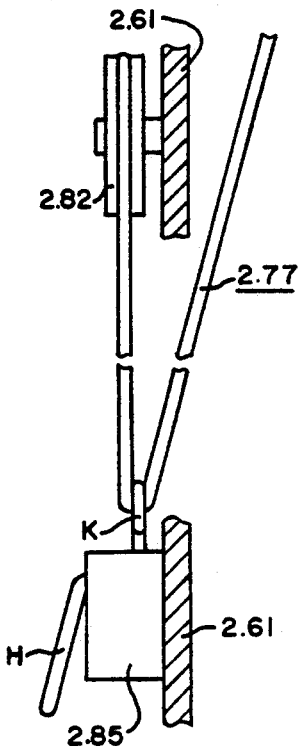
FIG. 15 is a right end view of FIG. 14.

The closure reset system 2.11 preferably includes trigger means for causing the holding means to release the second latch member 2.53 to thereby allow the second latch member 2.53 to move to the unlocked position and, in turn, unlock the endless chain 2.51 and allow gravity, etc., to rotate the axle A and force the fire door 2.13 to the closed position. The trigger means preferably includes a manual release means 2.85 mounted, for example, on the support means 2.61 to allow a worker to manually release the holding means by merely putting sufficient slack in the cable 2.77 as indicated by the arrow S in FIG. 16 to allow the finger 2.59 to pivot to the unlocked position and thereby release the endless chain 2.51 and allow the fire door 2.13 to move to the closed position as will now be apparent to those skilled in the art. The manual release means 2.85 may be of various specific construction as will now be apparent to those skilled in the art such as the Model A1-11-702-20 test handle made by Southco Inc. of Concordville, Pa. 19331. Thus, the manual release means 2.85 may include a handle H for being manually moved between a lowered or set position as shown in FIGS. 14 and 15, and a raised, test position as shown in FIG. 16, and a keeper K or the like for being operatively coupled to the handle H and the cable 2.77 in such a manner that movement of the handle H to the raised position will place slack in the cable 2.77 and movement of the handle H to the lowered position will remove slack from the cable 2.77 as will now be apparent to those skilled in the art.

Figure 11:
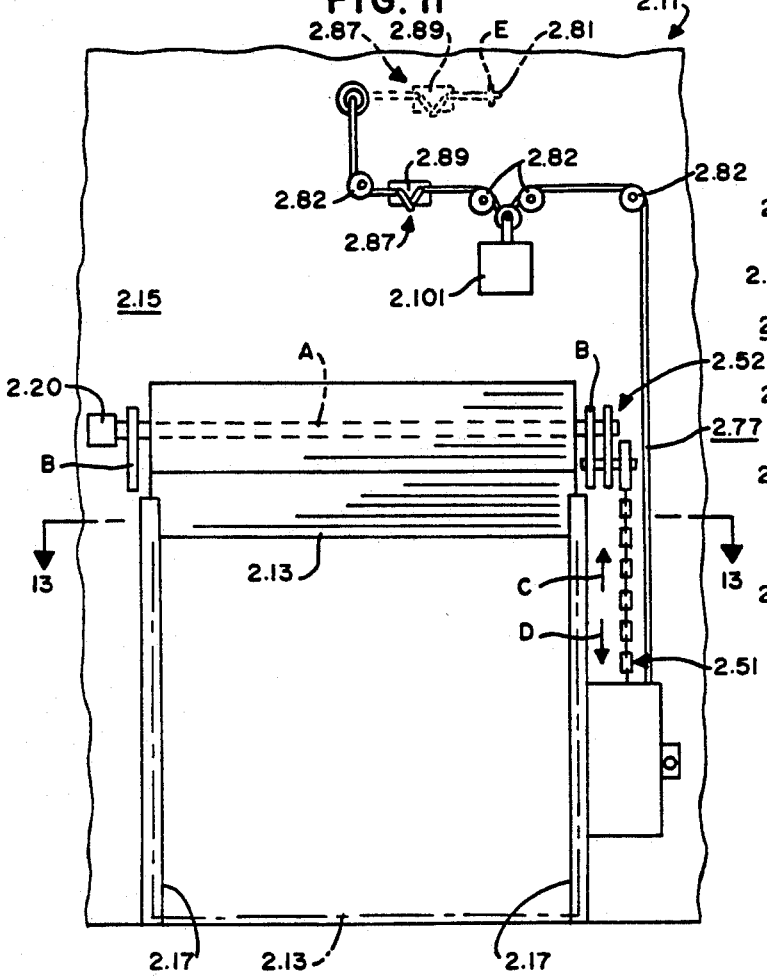
FIG. 11 is a somewhat diagrammatic front elevational view of a roll-up fire door with a second embodiment of the closure reset system of the present invention combined therewith.
Figure 12:
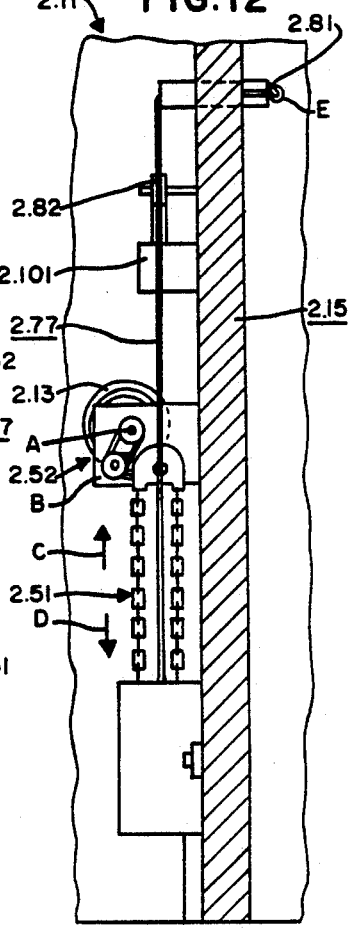
FIG. 12 is a side elevational view of FIG. 11.
Figure 13:
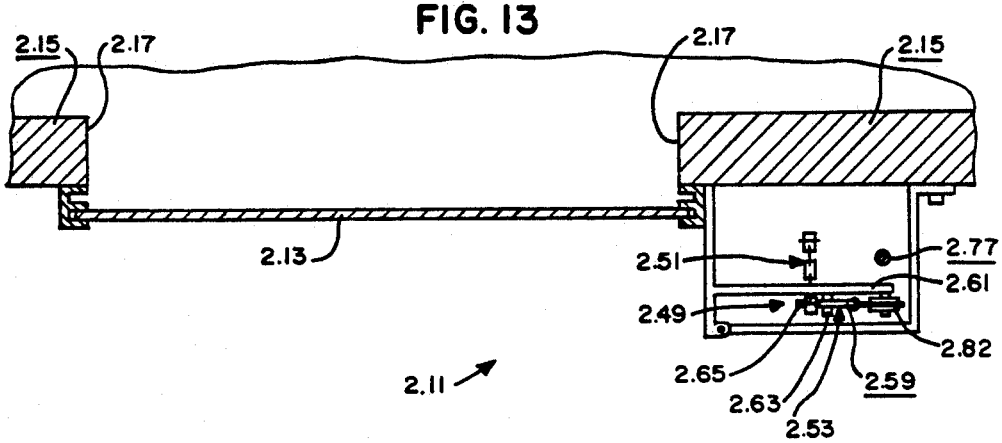
FIG. 13 is an enlarged sectional view substantially as taken on line 13—13 of FIG. 11.

The closure reset means 2.11 includes occurrence responsive means for placing slack in the cable 2.77 in the event of a predetermined occurrence. The occurrence responsive means is preferably part of the trigger means and preferably includes at least one alarm means 2.87 such as a fuse link means 2.89 for putting slack in the cable 2.77 in the event of a fire or the like as will now be apparent to those skilled in the art. The fuse link means 2.89 may include a typical fuse link having a first end fixedly attached to a first portion of the cable 2.77 and having a second end fixedly attached to a second portion of the cable 2.77 in a manner so that a loop or the like is formed between the first and second ends of the fuse link as will now be apparent to those skilled in the art. The loop is longer than the fuse link so that if the fuse link melts in the event of a fire or otherwise breaks, etc., the loop will create sufficient slack in the cable 2.77 to allow the finger 2.59 to pivot to the unlocked position and thereby release the endless chain 2.51 and allow the fire door 2.13 to move to the closed position as will now be apparent to those skilled in the art. The trigger means preferably includes a plurality of fuse link means 2.89. Two such fuse link means 2.89 are shown in FIG. 11, one on either side of the wall 2.15. However, any number of such fuse link means 2.89 can be combined with the cable 2.77 as will now be apparent to those skilled in the art.

The trigger means may also include a linear actuator release means or device 2.101 coupled to the cable 2.77 as shown in FIG. 11 for putting sufficient slack in the cable 2.77 when activated to allow the finger 2.59 to pivot to the unlocked position. The linear actuator release device 2.101 preferably includes a typical linear actuator such as the Model 6Z087 linear actuator made by Dayton Electric Mfg., Co. of Chicago, Ill. 60048. A battery backup system (not shown) is preferably coupled to the linear actuator release device 2.101 to allow operation thereof in the event of power failure. The battery backup system may include a float charger such as Model PSC-12500-F and a battery such as Model PS-1242, both made by Powersonic Corp. of Redwood City, Calif. A timer (not shown) may be coupled to the linear actuator release device 2.101 to activate the linear actuator release device 2.101 at preset times, etc. The timer may include any typical timer well known to those skilled in the art such as the Dayton electronic, 365-day, programmable, 2-circuit timer, Stock No. 5A687, manufactured by Dayton Electric Mfg., Co. of Chicago, Ill. 60048. The timer thus allows the fire door 2.13 to be closed when desired and without requiring an operator by merely programming the timer to activate the release device 2.101 at various specific times such as at night, on weekends, during holidays, etc., as will now be apparent to those skilled in the art. It should be noted that a single timer could be electrically coupled to a plurality of linear actuator release devices of a plurality of fire doors so that a single timer could control a plurality of linear actuator release devices as will now be apparent to those skilled in the art.

The closure reset system 2.11 is specifically designed to allow the fire door 2.13 to be quickly and easily opened and properly reset after a test thereof, etc. Thus, once the fire door 2.13 has been closed by the closure reset system 2.11 upon the occurrence of a predetermined event such as a test of the closure reset system 2.11 (e.g., after the manual release means 2.85 has been activated to test the closure reset system by merely moving the test handle thereof to the test or opened position), or after circumstances have activated the alarm means 2.87 (e.g., after a fire substantially adjacent a fuse link means 2.89, etc.), or after the linear actuator release device 2.101 has been activated, the cable 2.77 is again tightened in a manner which will now be apparent to those skilled in the art (i.e., by closing the manual release means 2.85 by merely moving the test handle thereof back to the set or closed position, replacing or repairing the fuse link means 2.89, or deactivating the release device 2.101, etc.) to cause the finger 2.59 of the second latch member 2.53 to move to the locked position (i.e., to urge the finger 2.59 to the position shown in FIG. 14). Then, the fire door 2.13 can be merely moved to the opened position by, for example, pulling the endless chain 2.51 in the direction of the arrow D and the link 2.55 of the endless chain 2.51 can be placed onto the tip 2.65 of the finger 2.59 to lock the endless chain 2.51 in place to prevent the fire door 2.13 from moving to the closed position as will now be apparent to those skilled in the art.

Operation of the closure reset system 2.11 is quite simple. With the test-reset means in the set position (e.g., with the handle H of the manual release means 2.85 in the lowered position) and with the occurrence responsive means in a ready-to-use condition (e.g., with the fuse link means 2.89, etc., in a normal, operation condition as will now be apparent to those skilled in the art), the cable 2.77 will be held substantially tight or taut, the latch member 2.53 will be held in the substantially horizontal, locked position, and with the tip 2.65 of the finger 2.59 extending into the slot 2.57 of the link member 2.55 of the endless chain 2.51, the fire door 2.13 will be locked in the opened position. To then test the closure reset system 2.13, a worker need only move the handle H of the manual release means 2.85 to the test or raised position whereby slack S will be placed in the cable 2.77, allowing the urging means 2.67 to urge the latch member 2.53 of the lock means 2.49 to the substantially vertical, unlocked position and, thereby, allowing the fire door 2.13 to move to the closed position. To then reset the closure reset system 2.11, the worker need only move the fire door 2.13 back to a raised position and move the handle H of the manual release means 2.85 back to the set or lowered position to thereby remove slack from the cable 2.77 and, assuming the fuse link means 2.89, etc., are in normal, operation conditions, cause the cable 2.77 to be held substantially tight or taut, thereby locking the fire door 2.13 in the raised position. It should be noted that the urging means 2.67 will hold the latch member 2.53 in the substantially vertical, unlocked position until the cable 2.77 is substantially tight or taut.

Figure 17:
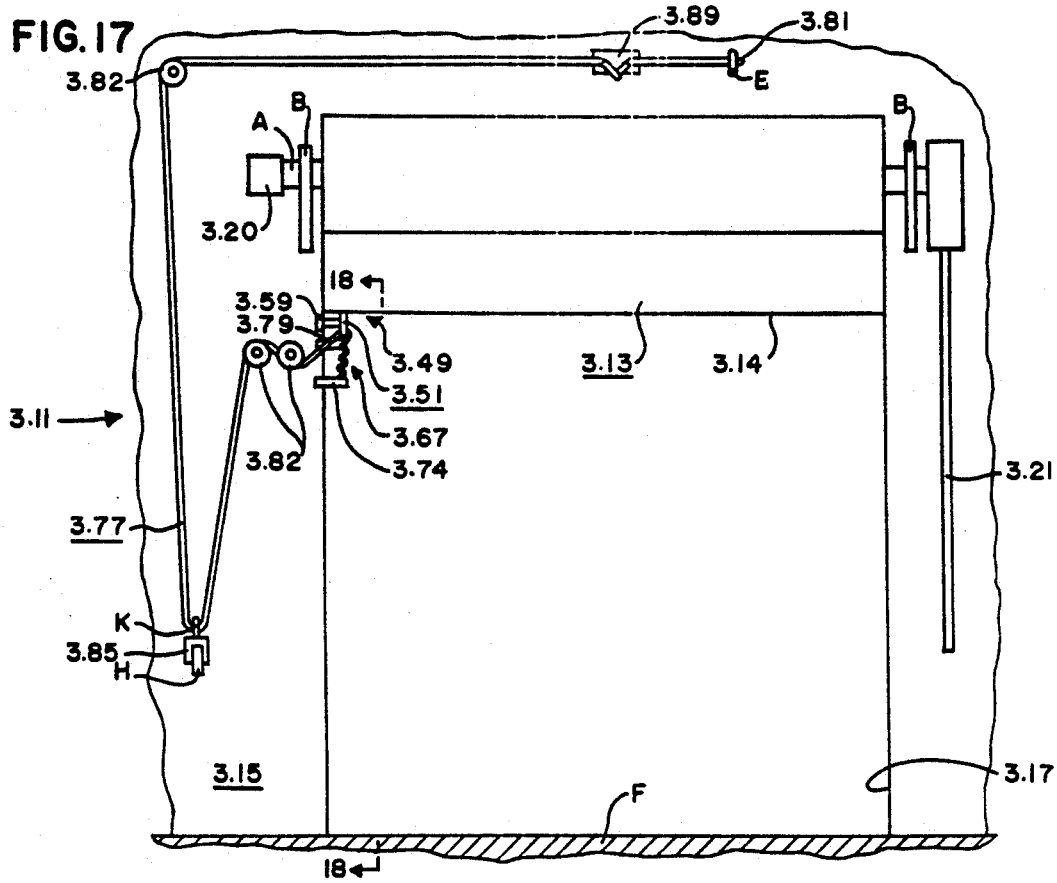
FIG. 17 is a somewhat diagrammatic front elevational view of roll-up fire door with a third embodiment of the closure reset system of the present invention combined therewith.
Figure 18:
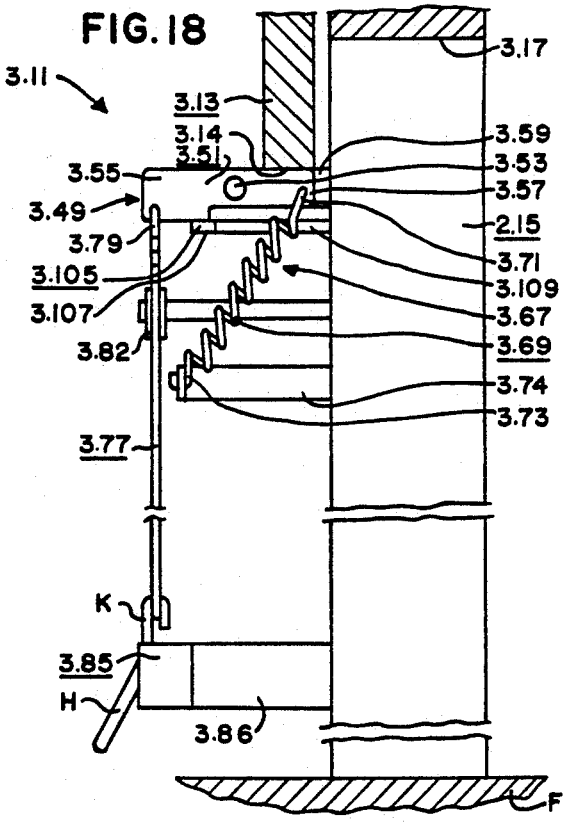
FIG. 18 is an enlarged sectional view substantially as taken on line 18—18 of FIG. 17 with certain portions thereof broken away for clarity.
Figure 19:
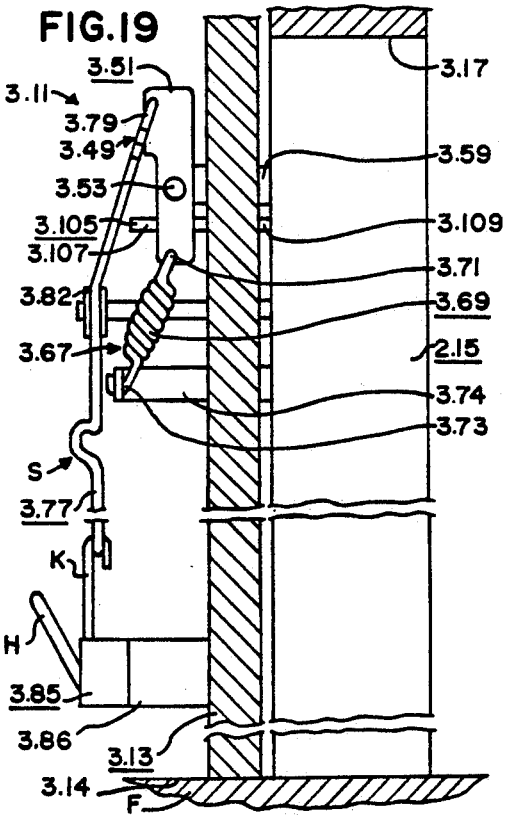
FIG. 19 is a sectional view similar to FIG. 18 but with portions thereof shown in moved positions.

A third preferred embodiment of the closure reset system of the present invention is shown in FIGS. 17-19 and identified by the numeral 3.11.

The closure reset system 3.11 includes or is designed especially for use in combination with a roll-up fire door 3.13 that is movably mounted on a wall 3.15 for selectively closing an opening 3.17 through the wall 3.15. Thus, the fire door 3.13 is movable between an opened position and a closed position relative to the opening 3.17 through the wall 3.15.

The closure reset system 3.11 includes control means for controlling movement of the fire door 3.13 from an opened position to a closed position. The control means of the closure reset system 3.11 is movable between an opened position and a closed position and the fire door 3.13 moves to the closed position when the control means moves to the closed position.

The control means preferably includes means for mounting the fire door 3.13 relative to the wall 3.15 in such a manner so that the fire door 3.13 can be moved between the opened and closed position in a controlled manner. More specifically, the fire door 3.13 may be rotatably mounted on the wall 3.15 by an axle A that is, in turn, rotatably mounted on the wall 3.15 by various support brackets B or the like as clearly shown in FIG. 17 for rotation movement between a closed position and an opened position to cause the fire door 3.13 to move between a closed position as shown in FIG. 19 in which the bottom edge 3.14 of the fire door 3.13 rests on the floor F or the like with the opening 3.17 through the wall 3.15 closed, and an opened position as shown in FIGS. 17 and 18 in which the bottom edge 3.14 of the fire door 3.13 is positioned above the floor F with the opening 3.17 through the wall 3.15 open, etc., as will now be apparent to those skilled in the art. Various cover members and the like have been omitted from the drawings for clarity and are not necessary for operation of the closure reset system 3.11. A primary function of the closure reset system 3.11 is to allow the fire door 3.13 to close in the event of a fire or during a test of the closure reset system 3.11, and to allow the closure reset system 3.11 to be easily reset thereafter.

The control means ia normally urged to the closed position. Thus, the fire door 3.13 may be designed so that gravity will normally cause the fire door 3.13 to move to the closed position, causing the axle A and related mechanisms to moved to a closed position as will now be apparent to those skilled in the art. The control means may include means such as spring means 3.20 coupled to the axle A for controlling the rate at which gravity will cause the axle A to rotate from the opened position to the closed position and, in turn, cause the fire door 3.13 to move from the opened position to the closed position. More specifically, the spring means 3.20 is preferably designed and set so as to allow gravity to slowly rotate the axle A and slowly move the fire door 3.13 from the opened position to the closed position to prevent damage to the fire door 3.13 and/or adjacent structure and to prevent injury to persons or things within the opening 3.17 when the fire door 3.13 moves from the opened to the closed position as will now be apparent to those skilled in the art. While the spring means 3.20 is shown diagrammatically in FIG. 17 as being mounted between the wall 3.15 and the axle A, it will be apparent to those skilled in the art that the spring means 3.20 might include a helical twist spring located inside the axle A, etc. An opening mechanism including, for example, a cable or chain 3.21 may be coupled to the fire door 3.13 through the axle A, etc., for allowing the fire door 3.13 to be opened as will now be apparent to those skilled in the art.

The closure reset system 3.11 includes lock means 3.49 for being pivotally attached relative to the wall 3.15 for movement between a locked position and an unlocked position and for allowing the fire door 3.13 to move to the closed position when the lock means 3.49 is in the unlocked position. The lock means 3.49 preferably consists of an elongated bar 3.51 pivotally attached relative to the wall 3.15 by a pivot member 3.53 such as a bolt or the like in a position so that the elongated bar 3.51 can pivot between a substantially horizontal, locked position as shown in FIGS. 17 and 18, and a substantially vertical, unlocked position as shown in FIG. 19. The elongated bar 3.51 has a first end 3.55 and a second end 3.57 with the pivot member 3.53 extending through the elongated bar 3.51 between the first and second ends 3.55, 3.57 as clearly shown in FIGS. 18 and 19. A bracket 3.59 may be provided for mounting the lock means 3.49 to the wall 3.15, etc. Thus, the bracket 3.59 may be fixedly attached to the wall 3.15 adjacent one upper corner of the opening 3.17 therethrough and the pivot member 3.53 may be attached to the bracket 3.59 in any manner now apparent to those skilled in the art to thereby pivotally attach the elongated bar 3.51 to the bracket 3.59 in such a position so that when the elongated bar 3.51 is in the substantially horizontal, locked position and the fire door 3.13 is in the opened position, at least a portion of the second end 3.57 of the elongated bar 3.51 will be positioned directly beneath a portion of the bottom edge 3.14 of the fire door 3.13 as clearly shown in FIG. 18 to thereby block the fire door 3.13 from moving to the closed position, and so that when the elongated bar 3.51 is in the substantially vertical, unlocked position, it is out of the path of the movement of the fire door 3.13 to allow the fire door 3.13 to move from the opened position to the closed position as clearly shown in FIG. 19.

The closure reset system 3.11 includes urging means 3.67 for urging the lock means 3.49 to the unlocked position. The urging means 3.67 preferably includes a spring 3.69 for normally holding the elongated bar 3.51 in the substantially vertical, unlocked position. The spring 3.69 may include a typical coil spring having a first end 3.7 attached to the elongated bar 3.51 at a position adjacent the second end 3.57 thereof, and having a second end 3.73 attached relative to the wall 3.15 (e.g., indirectly to the wall 3.15 through a bracket 3.74 or the like) whereby the elongated bar 3.51 will be urged to the substantially vertical, unlocked position as shown in FIG. 19 and as will now be apparent to those skilled in the art.

The reset means preferably includes holding means for normally holding the lock means 3.49 in the locked position. The holding means preferably includes a cable means or cable 3.77 for normally holding the elongated bar 3.51 in the substantially horizontal position when substantially tight and for allowing the elongated bar 3.51 to move to the substantially vertical, unlocked position when slack. The cable 3.77 has a first end 3.79 for being attached to the elongated bar 3.51 adjacent the first end 3.55 thereof (i.e., on the opposite side of the pivot member 3.53 from the first end 3.71 of the spring 3.69), and has a second end 3.81 for being fixedly anchored by, for example, being attached to the wall 3.15 or the like via an eyebolt E or the like, so that when the cable 3.77 is held substantially tight, the force of the spring 3.69 will be overcome and the elongated bar 3.51 will be held in the substantially horizontal, locked position as will now be apparent to those skilled in the art. Thus, the lock means 3.49 is held in the locked position when the cable 3.77 is taut while the urging means 3.67 will urge the lock means 3.49 to the unlocked position when slack is placed in the cable 3.77. A plurality of pulleys 3.82 or the like may be attached relative to the wall 3.15, etc., to control the path of the cable 3.77 between the elongated bar 3.51 and the eyebolt E as Will now be apparent to those skilled in the art.

The closure reset system 3.11 includes test-reset means for allowing the operation of the fire door closure reset system 3.11 to be tested by placing slack in the cable 3.77 and for allowing the slack in the cable 3.77 to be subsequently removed after the operation of the fire door closure reset system 3.11 is tested to reset the fire door closure reset system 3.11. The test-reset means preferably includes a manual release means 3.85 mounted relative to the wall 3.15 through a bracket 3.86 or the like to allow a worker to manually release the holding means by merely putting sufficient slack in the cable 3.77 as indicated by the arrow S in FIG. 19 to allow the elongated bar 3.51 to pivot to the substantially vertical, unlocked position and thereby allow the fire door 3.13 to move to the closed position as will now be apparent to those skilled in the art. The manual release means 3.85 may be of various specific construction as will now be apparent to those skilled in the art such as the Model A1-11-702-20 test handle made by Southco Inc. of Concordville, Pa. 19331. Thus, the manual release means 3.85 may include a handle H for being manually moved between a lowered, set position as shown in FIG. 18 and a raised, test position as shown in FIG. 19, and a keeper K or the like for being operatively coupled to the handle H and the cable 3.77 in such a manner that movement of the handle H to the raised position will place slack in the cable 3.77 and movement of the handle H to the lowered position will remove slack from the cable 3.77 as will now be apparent to those skilled in the art.

The closure reset means 3.11 includes occurrence responsive means for placing slack in the cable 3.77 in the event of a predetermined occurrence. The occurrence responsive means preferably includes fuse link means 3.89 for putting slack in the cable 3.77 in the event of a fire or the like as will now be apparent to those skilled in the art. Each fuse link means 3.89 may include a typical fuse link having a first end fixedly attached to a first portion of the cable 3.77 and having a second end fixedly attached to a second portion of the cable 3.77 in a manner so that a loop or the like is formed between the first and second ends of the fuse link as will now be apparent to those skilled in the art. The loop is longer than the fuse link so that if the fuse link melts in the event of a fire or otherwise breaks, etc., the loop will create sufficient slack in the cable 3.77 to allow the elongated bar 3.51 to pivot to the substantially vertical, unlocked position and thereby allow the fire door 3.13 to move to the closed position as will now be apparent to those skilled in the art. The occurrence responsive means may include a plurality of such fuse link means. For example, the occurrence responsive means may include two such fuse link means with one mounted on either side of the wall 3.15 adjacent the opening 3.17 similar to that disclosed hereinabove relative to the fuse link means 2.89 of the closure system 2.11. However, any number of such fuse link means can be combined with the cable 3.77 as will now be apparent to those skilled in the art. Further, the occurrence responsive means may include a linear actuator release means or device coupled to the cable 3.77 in a manner similar to that disclosed hereinabove relative to the linear actuator release device 2.101 of the closure system 2.11.

The closure reset system 3.11 preferably includes stop means 3.105 for stopping the elongated bar 3.51 in a substantially horizontal position when the cable 3.77 is substantially tight or taut. The stop means 3.105 may include a stop member 3.107 fixedly attached relative to the wall 3.15 and the elongated bar 3.51 by way of a bracket 3.109 or the like so that a portion of one edge of the elongated bar 3.51 will contact a portion of the top edge of the stop member 3.107 when the elongated bar 3.51 is substantially horizontal as clearly shown in FIG. 18. In addition, the stop means 3.105 may be designed for stopping the elongated bar 3.51 in a substantially horizontal position when slack S is present in the cable 3.77. Thus, the stop member 3.107 may be positioned so that a portion of one edge of the elongated bar 3.51 will contact a portion of the side edge of the stop member 3.107 when the elongated bar 3.51 is substantially vertical as clearly shown in FIG. 19.

Operation of the closure reset system 3.11 is quite simple. With fire door 3.13 in the opened position, with the test-reset means in the set position (e.g., with the handle H of the manual release means 3.85 in the lowered position) and with the occurrence responsive means in a ready-to-use condition (e.g., with the fuse link means 3.89, etc., in a normal, operation condition as will now be apparent to those skilled in the art), the cable 3.77 will be held substantially tight or taut, the elongated bar 3.51 will be held in the substantially horizontal, locked positions, and the fire door 3.13 will be locked in the opened position. To then test the closure reset system 3.13, a worker need only move the handle H of the manual release means 3.85 to the test or raised position whereby slack S will be placed in the cable 3.77, allowing the urging means 3.67 to urge the elongated bar 3.51 of the lock means 3.49 to the substantially vertical, unlocked position and, thereby, allow the fire door 3.13 to move to the closed position. To then reset the closure reset system 3.11, the worker need only move the fire door 3.13 back to the raised position and then move the handle H of the manual release means 3.85 back to the set or lowered position to remove slack from the cable 3.77 and, assuming the fuse link means 3.89, etc., are in normal, operating conditions, cause the cable 3.77 to be held substantially tight or taut, thereby locking the fire door 3.13 in the opened position. It should be noted that the urging means 3.67 will hold the elongated bar 3.51 in the substantially vertical, unlocked position as the fire door 3.13 is moved from the closed position back to the opened position.

Although the present invention has been described and illustrated with respect to preferred embodiments and preferred uses therefor, it is not to be so limited since modifications and changes can be made therein which are within the full intended scope of the invention.

I claim:

1. A fire door closure reset system comprising, in combination:

a) a fire door movable between an opened position and a closed position relative to an opening through a wall;

b) lock means for being pivotally attached relative to the wall for movement between a locked position and an unlocked position and for allowing said fire door to move to said closed position when in the unlocked position;

c) urging means for urging said lock means to said unlocked position;

d) a cable having a first end for being attached to said lock means and having a second end for being fixedly attached relative to the all; said lock means being held in said locked position when said cable is taut; said urging means urging said lock means to said unlocked position when slack is placed in said cable;

e) occurrence responsive means for placing slack in said cable in the event of a predetermined occurrence; and f) test-reset means for allowing the operation of said fire door closure reset system to be tested by placing slack in said cable and for allowing the slack in said cable to be subsequently removed after the operation of said fire door closure reset system is tested to reset said fire door closure reset system; said test-reset means including trigger means, easily movable between a first position and a second position, for placing slack in said cable to allow said urging means to move said lock means to said unlocked position when moved to said first position and for removing slack from said cable and forcing said lock means back to said locked position when moved to said second position.

2. A fire door closure reset system for a fire door that is movable between an opened position and a closed position relative to an opening through a wall; said closure reset system comprising:

a) control means for controlling movement of said fire door from said opened position to said closed position, said control means being movable between an opened position and a closed position; said fire door moving to said closed position when said control means moves to said closed position, said control means being normally urged to said closed position;

b) continuous cable means for movement between an opened position and a closed position and for being attached to said control means in such a manner that said control means will be prevented from moving from said opened position to said closed position when said continuous cable means is located in said opened position and in such a manner that said control means will be moved from said closed position to said opened position when said continuous cable means is moved from said closed position to said opened position;

c) lock means for locking said continuous cable means in said opened position; said lock means including a first latch means for being fixedly attached relative to said continuous cable means and including a second latch means for being attached relative to said wall; said second latch means having a first position in which said first latch means can be locked thereto for locking said continuous cable means in said opened position and having a second position in which said first latch means is released therefrom for allowing said continuous cable means to be moved to said closed position to allow said control means to be urged to said closed position so that said fire door will move to said closed position; and d) reset means for urging said second latch means of said lock means to said first position so that said first latch means can be easily and quickly relocked to said second latch means for locking said continuous cable means in said opened position after said fire door has moved to said closed position when said fire door is subsequently moved back to said opened position; said reset means including holding means for holding said second latch means in said first position; said holding means of said reset means including cable means for holding said second latch means in said first position when substantially tight and for allowing said second latch means to move to said second position when slack; said cable means having a first end for being attached to said second latch means and having a second end for being secured relative to said wall.

3. A fire door closure reset system for a fire door that is movable between an opened position and a closed position; said closure reset system comprising:

a) closure means for forcing said fire door to said closed position; said closure means including a closure member movable between an opened position and a closed position;

b) lock means having a locked position for locking said closure member of said closure means in said opened position and having an unlocked position for allowing said closure member of said closure means to move to said closed position upon the occurrence of a predetermined event; and c) reset means for easily and quickly re-locking said lock means after said fire door has moved to said closed position and has been subsequently reopened; said fire door being allowed to remain in said opened position when said closure member is in said opened position and being forced to said closed position when said closure member moves to said closed position; said closure means including urging means for normally urging said closure member to said closed position; said lock means including a first latch member attached to said closure means and a second latch member attached to said wall; said second latch member having a first position in which said first latch member can be locked thereto to hold said closure member in said opened position and having a second position in which said first latch member is released therefrom to allow said closure member to move to said closed position; said closure means including a closure cable for being coupled to said closure member; said closure cable having a first end for being attached to said closure member and having a second end for being coupled to said urging means of said closure means; said closure means including first pulley means mounted relative to said wall on one side of said opening, second pulley means mounted relative to said wall on the other side of said opening, and a continuous cable extending between said first and second pulley means; said continuous cable being coupled to said first end of said closure cable; said closure means including a closure lug attached to said continuous cable for forcing said fire door to said closed position when said closure cable moves to said closed position; said closure means including catch bracket means for being attached to said fire door and for engaging said closure lug when said closure member moves from said opened position to said closed position; said first latch member of said lock means being fixedly attached to said closure member.

* * * * *